US005699637A

United States Patent [19]

Marocco

[11] Patent Number: 5,699,637

[45] Date of Patent: Dec. 23, 1997

[54] ARCH FRAME

[75] Inventor: Norbert Marocco, Woodbridge, Canada

[73] Assignee: Shade-O-Matic Limited, North York, Canada

[21] Appl. No.: 701,505

[22] Filed: Aug. 22, 1996

[51] Int. Cl.[6] ..... E06B 3/30

[52] U.S. Cl. ..... 52/204.53; 52/85; 52/86; 52/204.1; 52/730.5; 52/217; 52/211; 52/213; 52/456; 52/204.5

[58] Field of Search ..... 52/204.1, 210, 52/211, 213, 204.5, 204.53, 204.597, 217, 314, 456, 86, 85, 730.3, 730.5, 63, 631

[56] References Cited

U.S. PATENT DOCUMENTS

| | | | |
|---|---|---|---|
| 3,475,870 | 11/1969 | Birum, Jr. | 52/730.5 X |
| 3,489,199 | 1/1970 | Weikel et al. | 52/456 X |
| 4,671,035 | 6/1987 | Ridge | 52/304.1 X |
| 5,044,131 | 9/1991 | Fisher | 52/63 |
| 5,076,033 | 12/1991 | Patsy, Jr. | 52/222 |
| 5,555,695 | 9/1996 | Patsky, Jr. | 52/730.5 X |

*Primary Examiner*—Carl D. Friedman
*Assistant Examiner*—W. Glenn Edwards

[57] ABSTRACT

A plurality of elongated thermoplastic bar members, each bar member defining a pre-determined width, and a pre-determined thickness which is less than its width, and each bar member being made up of an outer facing panel, and an inner wall and intermediate spacer walls extending between the facing panels and inner walls at intervals, and defining therebetween generally elongated passageways, and at least some of the bars having interlock formations formed on the exterior of the facing panels, so that adjacent bars may be interlocking together, the interlock formations defining continuous tongue and groove slide members, permitting one bar member to slide relative to its adjacent bar members, and at least one of bar members having one panel free of the interlock formations, so as to provide a smooth finished exterior surface.

9 Claims, 3 Drawing Sheets

ARCH FRAME

FIELD OF THE INVENTION

The invention relates to an arch frame suitable for forming an arcuate shape of a variety of different radii, and can be used for producing a variety of different construction products, decorative effects and the like, and in particular, window frames, door frames, fan lights and the like.

BACKGROUND OF THE INVENTION

Arch frames are frequently required to produce construction products, or interior decorative effects. In construction, it is frequently desirable to provide windows, and doors and door frames with an arch like shape at the top, so as to produce the appearance of an arch shaped window frame, or a fan light over a door way, to name only a few of such uses. The uses of such arch products for indoor decoration are almost unlimited.

In the past, the general practice has been to fabricate arches to a predetermined desire radius, using either wood materials or in some cases metal. In some cases the arch was built up of segments each defining a pre-determined radius, and the segments being joined together with provide a complete arch. The same may also have been carried out in metal fabrication.

In other cases, especially in residential construction, arch frames for windows and fan lights were constructed on site by using in many cases a single piece of wood, and making a series of saw-cuts to allow the piece of wood to bend to a predetermined radius. These techniques were relatively expensive, and also required a high degree of skill to produce a satisfactory result. As a result, the use of arches in construction, and indeed in interior decoration, has been limited, due to the cost of such techniques.

Clearly, it is desirable to provide a system for producing an arch frame, using relatively inexpensive materials, and without requiring a great deal of skill.

It is also clearly desirable to provide such a system in which the arch frame can be bent to various predetermined arcs, so as to suit a wide variety of different applications. It is also desirable to manufacture such an arch out of materials which can be used in exterior construction, without deterioration due to effects of the weather, temperature, rain, snow and the like, and which will be resistant to strong sunlight.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF SUMMARY OF THE INVENTION

With a view to achieving the foregoing advantages, the invention comprises an arch frame, in turn comprising a plurality of elongated thermoplastic bar members, each bar member defining a pre-determined width, and a pre-determined thickness which is less than its width, and each bar member being made up of outer walls and intermediate spacer walls extending between said outer walls at intervals, and defining therebetween generally elongated passageways, and at least some of said bars having interlocking formations formed on the exterior of said walls, whereby adjacent said bars may be interlocking together, said interlock formations defining continuous slide members, permitting one said bar member to slide relative to its adjacent said bar members. In one embodiment at least one of said bar members has one said panel free of said interlocking formations, whereby to provide a smooth finished exterior surface.

The invention further provides such an arch frame and wherein the plurality of bars are first of all interlocked together, and are then bent into an arch shape and including fastening means passing through said plurality of bars at spaced intervals, whereby to hold the same in their predetermined arch shape.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
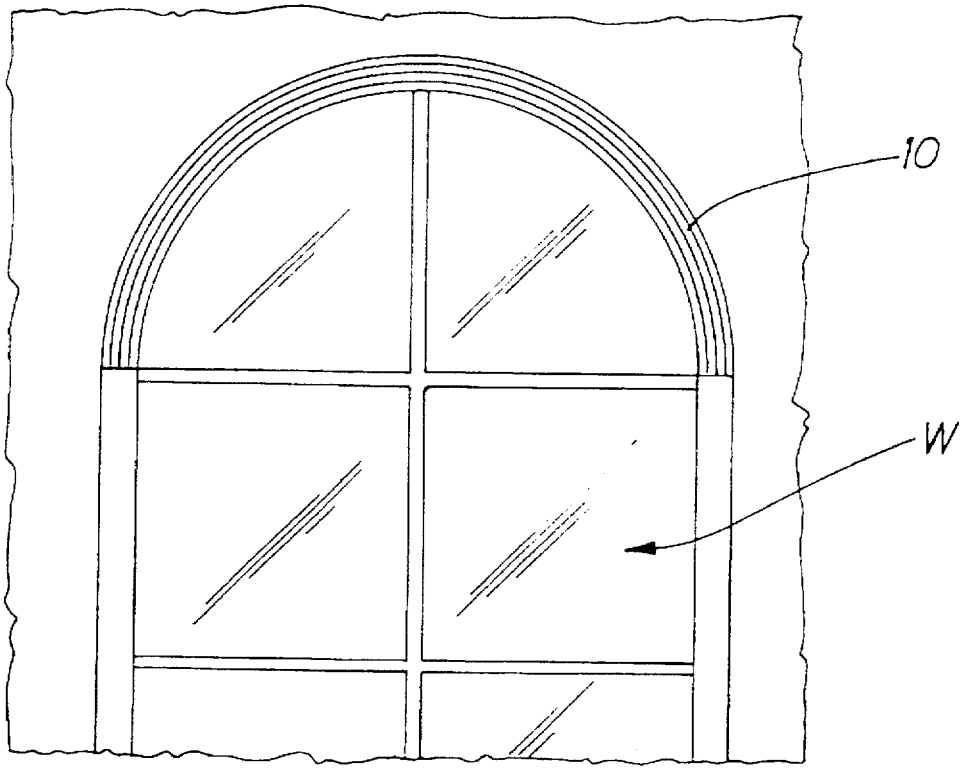
FIG. 1 is a perspective illustration of a plurality of bars interlocked together to illustrate the invention in the form of a window arch.

As shown generally in FIG. 1, the invention is there illustrated as an arch frame shown generally as 10, shown above a window, and forming a decorative upper end to such window.

Figure 2:
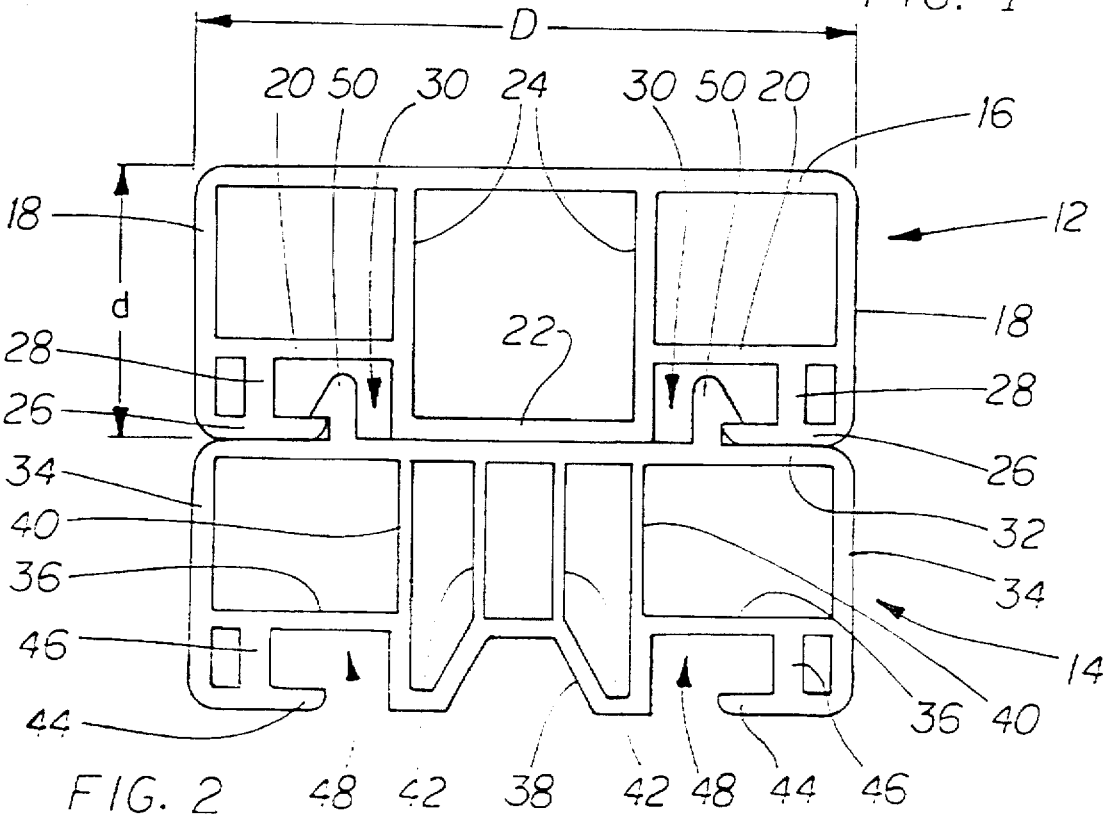
FIG. 2 is an end elevation of a first and second bar illustrating the invention showing interlocked formations thereon.
Figure 3:
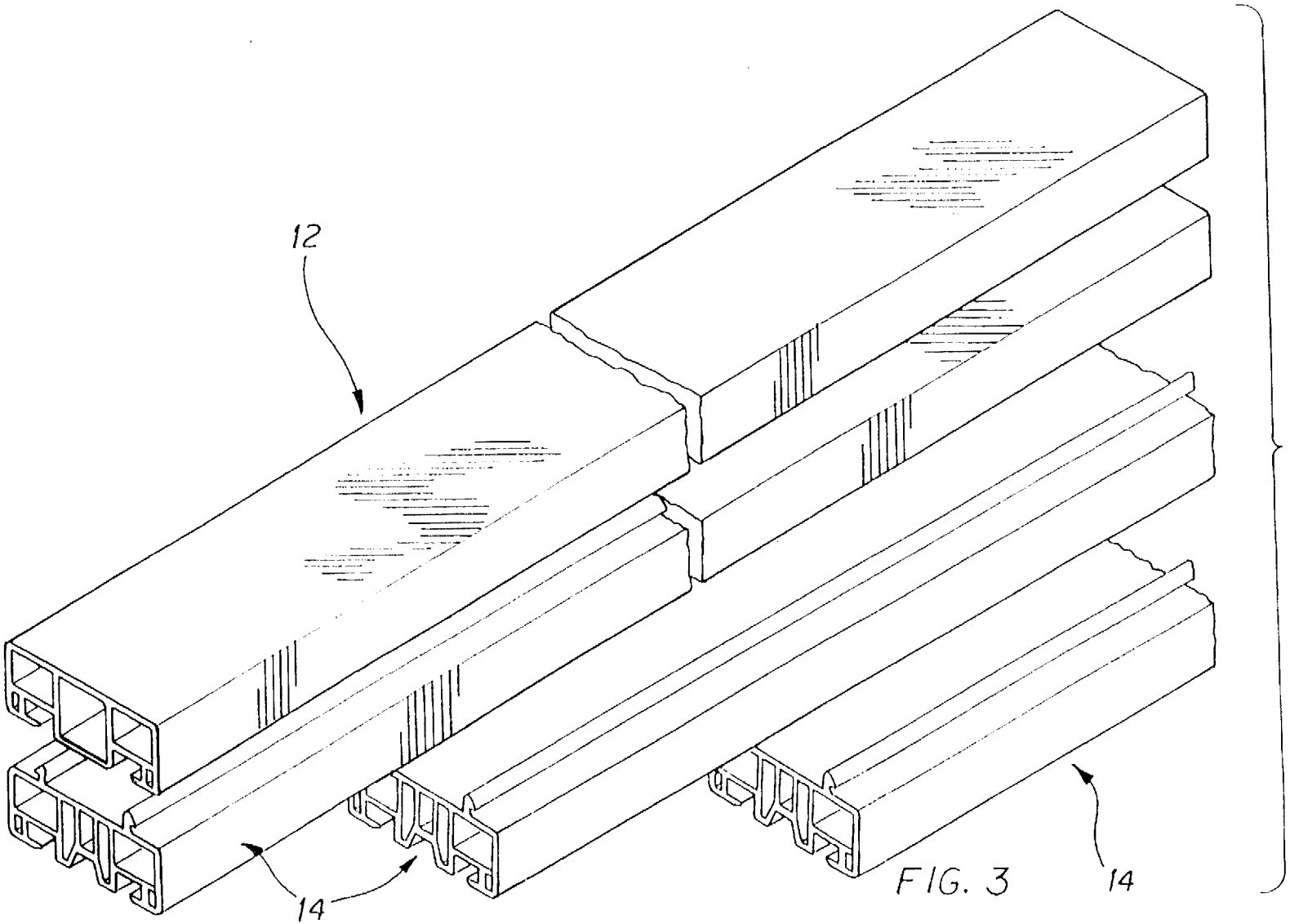
FIG. 3 is a perspective of a plurality of bars illustrating the invention, and showing interlock formations on one side and a smooth surface on the other side.

The arch frame is illustrated in this case in FIGS. 2 and 3 in the form of a plurality of bars 12 and 14. The bars 12–14 are formed of extruded thermoplastic material, and have a width dimension D, and a depth dimension d. The depth dimension d is less than the width dimensions D for reasons to be described below.

Bar 12 constitutes an outer or finish bar, and comprises a first outer wall 16, and outer side walls 18—18 which are generally right angular with wall 16.

Between the walls 18—18, there is a second outer wall 20, extending inwardly from either side, and joining a central channel wall 22.

Intermediate partition walls 24—24 extend from channel wall 22, and merge with wall 16, and define a generally hollow space. The intermediate walls 24 are also spaced from the side walls 18 and again define generally rectangular spaces.

At the inward ends of side walls 18, there are interlocking walls 26—26 extending inwardly, and supported by support walls 28—28, joining walls 20—20.

Between the inward ends of locking walls 26—26 there are defined locking channels 30—30, for purposes to be described.

Bar 14 is an intermediate bar and there may in fact be several such bars 14 depending upon the desired thickness of the arch 10. Each of the bars 14 comprise a first outer wall 32 and outer side walls 34—34. Second outer walls 36—36 extend inwardly from walls 34, and meet at a generally W shaped channel 38.

There are in this embodiment four interior support walls 40—40 and 42—42. Walls 40 extend from the junction between walls 36 and the channel 38.

Walls 42 extend from the apex from the channel 38 at spaced apart intervals, and all four walls 40—40 and 42—42 merge with the wall 32.

Locking walls 44 are formed generally at right angles on the inward edges of side walls 34.

The locking walls 44, together with walls 36 and support wall 46 define locking spaces 48.

Locking hooks or tongues 50 are formed on the outer wall 32 extending outwardly into the locking spaces 30 of the bar 12.

Further intermediate bars 14 may be made and having the same features as that described above, and may be interlocked successively with bar 14, so as to build up a thicker arch, if desired (see FIG. 3).

In operation, a sufficient number of bars, usually consisting of one outer bar 12 and a plurality of intermediate bars 14, will be interlocked with one another, substantially as shown in FIG. 3.

It will be appreciated that in this condition, while the bars are interlocked with one another, the interlocking formations namely the walls 26 and 44 and the hooks 50, can slide longitudinally relative to one another.

Figure 4:
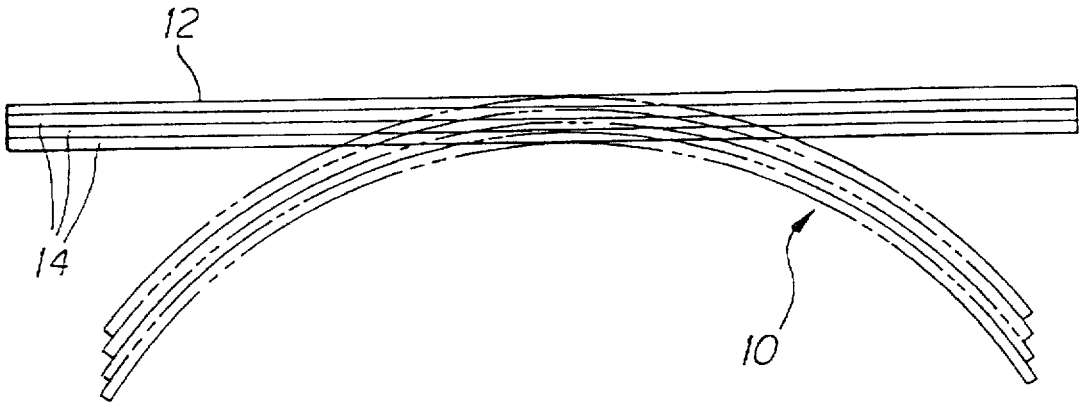
FIG. 4 is a side view illustrating a plurality of bars, straightened out, and showing bending in phantom.

In order to form an arch of a predetermined arc, the straight bars indicated as 12 and 14 in FIG. 4, will be flexed and bent as shown in phantom in FIG. 4, to form an arch 10. As the bars flex, the ends of the bars will move relative to one another as shown in FIG. 4.

Figure 5:
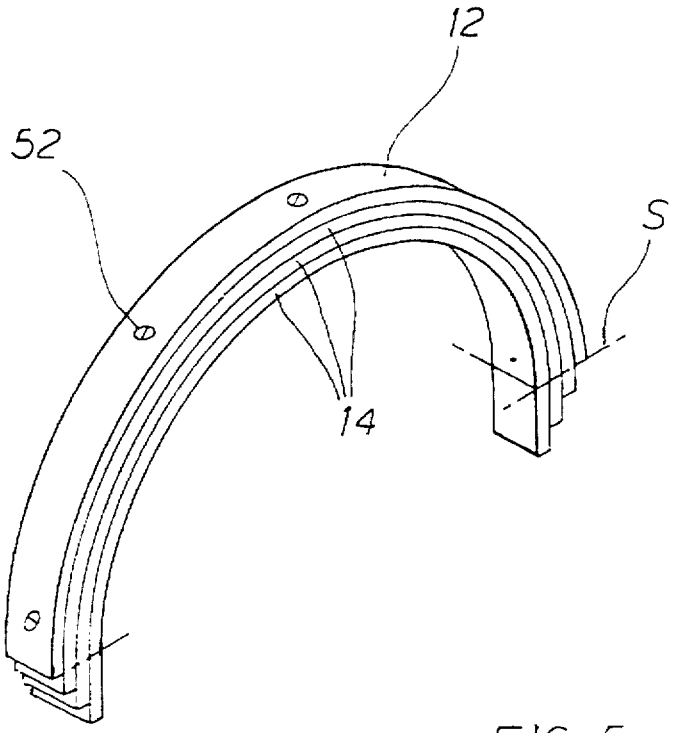
FIG. 5 is a perspective illustration of an arch frame formed of a plurality of bars illustrated in FIGS. 1 through 3, showing the same bent into a pre-determined arc, and showing fastening means at intervals securing the bars in their predetermined bent position.

In order to hold the arch in the predetermined bent arc position, a plurality of fastening screws 52—52 FIG. 5, are then screwed through from the exterior of the outer bar 12, through all of the intermediate bars 14, the screws being intended to pass between pairs of inner partition walls 42—42, in each of the intermediate bars.

Once secured by a sufficient number of screws, the ends of the bars may be trimmed by cutting or sawing as at S to form square ends at each end of the arch.

The arch can then be placed in position for example over a window, or anywhere else where it may be desired to install an arch.

The arch being formed of thermoplastic material may be pigmented permanently with a desired colour, thereby rendering it weather proof and maintenance free.

The fact that each of the bars has a width dimension D which is greater than the depth dimension d, renders each of the individual bars 12–14 etc. sufficiently flexible through their depth that the flexing of the bars to form the arch can be achieved relatively easily, and manually by one man if desired.

It will be appreciated that while the invention is described for use in arch frames for windows, it will also be of use in other situations where an arched frame work is required such as over a door, skylight, or for example in supporting a roof of a greenhouse or atrium.

Various different interlocking formations may be provided for interlocking one of the bars with another, and these may be placed on adjacent interfaces as shown in FIGS. 1 to 4, or they may placed on side walls of the bars, without departing from the scope of the invention. The arches, when formed, may be used in a variety of different uses besides simply providing a window arch, i.e. they can be used as a frame for a roof or a wall of glass, or for a curved roof as in a greenhouse or atrium.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A composite arch frame comprising:

a plurality of elongated thermoplastic bar members, each bar member defining a pre-determined width, and a pre-determined thickness which is less than its width, and each bar member being made up of outer walls, and intermediate spacer walls extending between said outer walls at intervals, and defining there between generally elongated passageways:

interlock formations formed on the exterior of some of said outer walls of at least some of said bar members, interlock recesses formed on some other of said walls whereby adjacent bar members are interlocked together, said interlock formations and recesses defining continuous slide members, permitting one said bar member to slide relative to said adjacent bar members.

2. A composite arch frame as claimed in claim 1 and wherein the plurality of bar members are first interlocked together, and are then bent into an arch shape and including fastening means passing through said plurality of bar members at spaced intervals, whereby to hold the same in their predetermined arch shape.

3. A composite arch frame as claimed in claim 1 including interlock recesses defined by one of said walls of said bar members, adapted to interlock with said interlock formations, for interlocking adjacent bar members together.

4. A composite arch frame as claimed in claim 3 including locking walls formed integrally with said outer walls and defining said interlock recesses.

5. A composite arch frame as claimed in claim 1 and including a channel shaped formation formed integrally between said outer walls.

6. A composite arch frame as claimed in claim 5 including two intermediate support walls formed integrally between said channel shaped information structure and said outer walls.

7. A method of making an arch frame consisting of a plurality of elongated thermoplastic bar members, each bar member defining a pre-determined width, having interlock formations formed on the exterior of at least some of said bar members, and comprising the steps of interlocking adjacent bar members together, said interlock formations defining continuous slide members, permitting one said bar members to slide relative to said adjacent bar members, and, flexing said bar members into an arch.

8. A method of making an arch frame as claimed in claim 7 and including the step of fastening said plurality of bar members at spaced intervals, whereby to hold the same in their predetermined arch shape.

9. A composite arch frame as claimed in claim 1, and wherein at least one of said bar members has one said outer wall free of said interlock formations whereby to provide a smooth finished exterior surface on said one outer wall.

* * * * *